United States Patent [19]

Orndorff et al.

[11] Patent Number: 4,924,974

[45] Date of Patent: May 15, 1990

[54] ELEVATOR SYSTEM HAVING HALL LANTERN ASSEMBLY FOR ELEVATOR CAR DOOR POST OF HATCH DOOR POST

[75] Inventors: Karl B. Orndorff, Bonneauville Boro; Randall S. Lawson, Gettysburg, both of Pa.

[73] Assignee: Inventio AG, Hergiswil NW, Switzerland

[21] Appl. No.: 295,697

[22] Filed: Jan. 11, 1989

[51] Int. Cl.[5] ..... B66B 9/00

[52] U.S. Cl. ..... 187/1 R; 362/76; 187/136

[58] Field of Search ..... 187/1 R, 56, 134, 136, 187/137; 362/76, 287, 20, 386, 254, 367; 49/404

[56] References Cited

U.S. PATENT DOCUMENTS 2,998,500 8/1961 Carlo ..... 187/1 R
4,276,449 2/1988 Orndorff et al. ..... 187/1 R
4,678,062 7/1987 Samka ..... 187/1 R
4,708,223 11/1987 Orndorff et al. ..... 187/1 R

*Primary Examiner*—F. J. Bartuska
*Assistant Examiner*—Kenneth Noland
*Attorney, Agent, or Firm*—D. R. Lackey

[57] ABSTRACT

An elevator system including a door post having inner and outer sides, and a hall lantern assembly fixed to the inner side. The door post includes a jamb defining upper and lower openings, and the hall lantern assembly includes upper and lower lenses which are resiliently biased to project through the upper and lower openings, respectively, in operating positions of the lenses. The upper and lower lenses have service positions achievable by depressing a lens against the bias, and then slidably moving the lens in a vertical direction, with the service positions of the upper and lower lenses enabling the hall lantern assembly to be serviced through the upper and lower openings in the jamb.

11 Claims, 4 Drawing Sheets

ELEVATOR SYSTEM HAVING HALL LANTERN ASSEMBLY FOR ELEVATOR CAR DOOR POST OF HATCH DOOR POST

TECHNICAL FIELD

The invention relates to hall lanterns for elevator systems, mounted either in a door post adjacent to an elevator hatch door, or in a door post of an elevator cab.

BACKGROUND ART

It is common in the prior art to mount up and down direction hall lanterns in a door strike post of an elevator cab having side opening doors, or a return post of a cab having center opening doors. The lamps of the hall lanterns are mounted in an electrical junction box behind a small removable face plate, fixed to the post. The removable face plate holds the hall lantern lenses in a functional position in front of the lamps, and its removal permits the lamps to be replaced when burned out. Visible hardware invites vandalism, and the visible face plate detracts from the aesthetics of the cab. A prior art alternative to a face plate is a swing return, which would be opened for bulb replacement, but a swing return adds substantial cost to a cab.

U.S. Pat. No. 4,726,449, which is assigned to the same assignee as the present application, eliminated the need for a face plate as well as the need for a swing return, by a new door strike post construction for side opening doors, referred to as a "pop-out strike". The pop-out strike includes an inner stationary post and an outer post which functions as a removable cover for a hall lantern assembly which is attached to the inside of the outer post. While substantially less costly than a swing return, a pop-out strike still adds a significant cost to a cab, and it has a disadvantage of only being applicable to side opening doors.

It is also common to mount hall lanterns in a door post of a hatch door entrance in the hallways of a building served by an elevator system, where removable lenses and or face plates also invite vandalism.

It is an object of the present invention to provide hall lanterns suitable for mounting in the door post of a hatch or car door without requiring a removable face plate, visible fasteners, a swing return, or a pop-out strike. When cab mounted it is an object of the invention to provide a hall lantern assembly which may be installed in either a return or a strike post, and thus applicable to both center opening and side opening car doors.

SUMMARY OF THE INVENTION

Briefly, the present invention relates to elevator systems having hall lanterns which may be mounted in a hatch door post; or, either a strike post or a return post of an elevator cab, as desired. The door post need only be a single piece structure having a flat jamb surface, the same as would be used for a cab without a car lantern. The only modification required to the door post is to provide upper and lower openings for receiving upper and lower lenses of the hall lantern assembly.

The hall lantern assembly may be attached to the inside surface of the jamb with an adhesive, to add structural stiffness to the jamb; or, when the jamb has an adequate thickness, the hall lantern assembly may be attached to the inside surface of the jamb via studs which have been stud welded to the inner surface of the jamb.

The upper and lower lenses are captured between the jamb and a lens guide plate which is resiliently biased towards the jamb to hold projecting portions of the upper and lower lenses in the upper and lower openings formed in the jamb. Thus, accidentally striking the lens after assembly with a door post, during manufacture, assembly or use of the cab will not damage the lens, as it will retract and return to its former position.

Access to the hall lantern lamps for replacement, as well as access to an associated terminal block and wiring, is from the external side of the door post. The upper and/or lower lens may be quickly moved to a service position by one having knowledge of the feature, simply by pressing the projecting portion of a lens to a clearance position, and then sliding the lens vertically, up or down, depending upon whether the lens is the upper or lower lens. Access to the lamps is provided via the associated lens opening in the jamb, and openings provided in the lens guide plate. The terminal block may be quickly removed for better access, if required, and just as quickly replaced, as it is attached to the assembly via a hook-like fastener arrangement, such as those available commercially from 3M Corporation under the identifications of Scotchmate or Scotchlock.

BRIEF DESCRIPTION OF THE DRAWINGS

The invention will become more apparent by reading the following detailed description in conjunction with the drawings, which are shown by way of example only, wherein.

DESCRIPTION OF PREFERRED EMBODIMENTS

The invention will be described relative to hall lanterns carried by a door post of an elevator cab, but the invention is equally applicable to hall lanterns mounted in a hatch door entrance post in a hall way of a building.

While hall lanterns are usually called car or cab lanterns when carried by an elevator cab, the term "hall lanterns" will be used throughout the specification to indicate the lanterns which signify car arrival and travel direction, regardless of where the lantern assembly is mounted.

Figure 1:
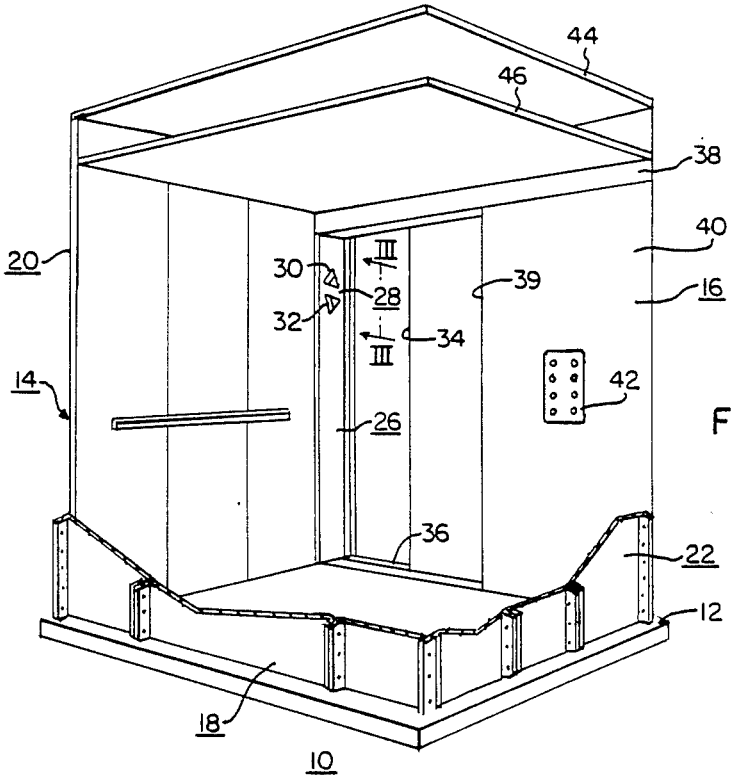
FIG. 1 is a perspective view of an elevator cab, shown partially cut away, which may carry a hall lantern assembly constructed according to the teachings of the invention.

Referring now to the drawings, and to FIG. 1 in particular, there is shown an elevator cab 10 which may carry a hall lantern assembly constructed according to the teachings of the invention. Cab 10 includes a platform 12 upon which upstanding wall portions are assembled to define an enclosure 14, with the upstanding wall portions including front, rear, and first and second sidewalls 16, 18, 20 and 22, respectively. For purposes of example, the front wall 16 defines a passenger entrance or opening 24 of the side opening type, but the invention is equally applicable to a cab having center opening doors. With a side opening, a door strike post 26 is provided at one side of opening 24. With a side opening door, the door strike post 26 preferably includes a hall lantern assembly 28, with only up and down lenses 30 and 32, respectively, being externally visible. The hall lantern assembly 28 could also be associated with the jamb surface 39 of a return 40, if desired. With center opening doors, hall lantern assembly 28 would be associated with a return door post.

A door 34 having one or more panels, as desired, is mounted for guided movement via a door operator (not shown) and a door sill 36, to open and close the entrance opening 24. The front wall portion, in addition to the return 40, may also include a transom 38 and a car station 42 mounted in the return 40. A canopy 44 is attached to the upper edges of enclosure 14, to which appropriate lighting fixtures may be attached, and a drop ceiling 46 may be suspended from the canopy.

Figure 2:
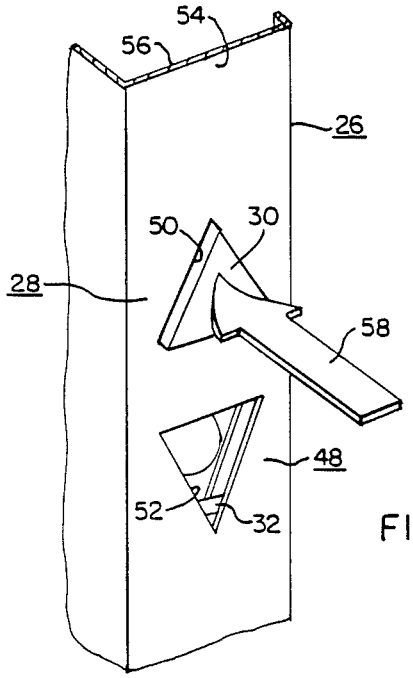
FIG. 2 is a fragmentary perspective view of the jamb of a door post shown in FIG. 1, except with the lower hall lantern lens in a service position, and illustrating with an arrow the force direction required to actuate the upper hall lantern lens from its operative position to a service position.

As will be more clearly apparent from FIG. 2, which is a fragmentary perspective view of door post 26, there is no removable face plate associated with hall lantern assembly 28, or visible fasteners. Door post 26 includes a flat jamb 48 which extends from platform 12 to the top of opening 24, with upper and lower openings 50 and 52, respectively, extending between outer and inner surfaces 54 and 56, respectively. The lower lens 32 is illustrated in a service position, which will be hereinafter explained in detail, and the upper lens 30 is illustrated in its operative position. Arrow 58 illustrates the force direction required to actuate upper lens 30 to a service position, including a force which initially depresses the lens and then lifts it vertically upward once the lens is back of upper opening 50.

Figure 3:
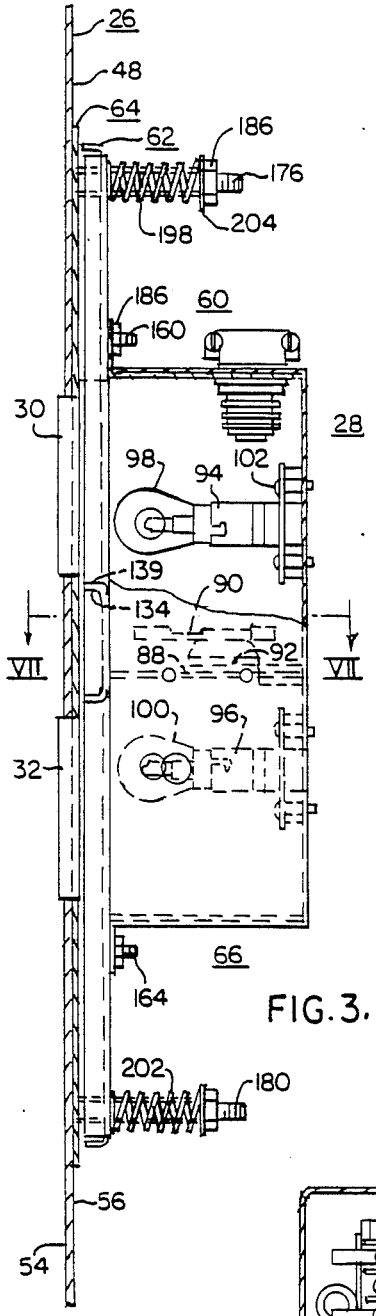
FIG. 3 is a side elevational view, partially in section, of a hall lantern assembly constructed according to the teachings of the invention, taken between and in the direction of arrows III—III in FIG. 1.
Figure 4:
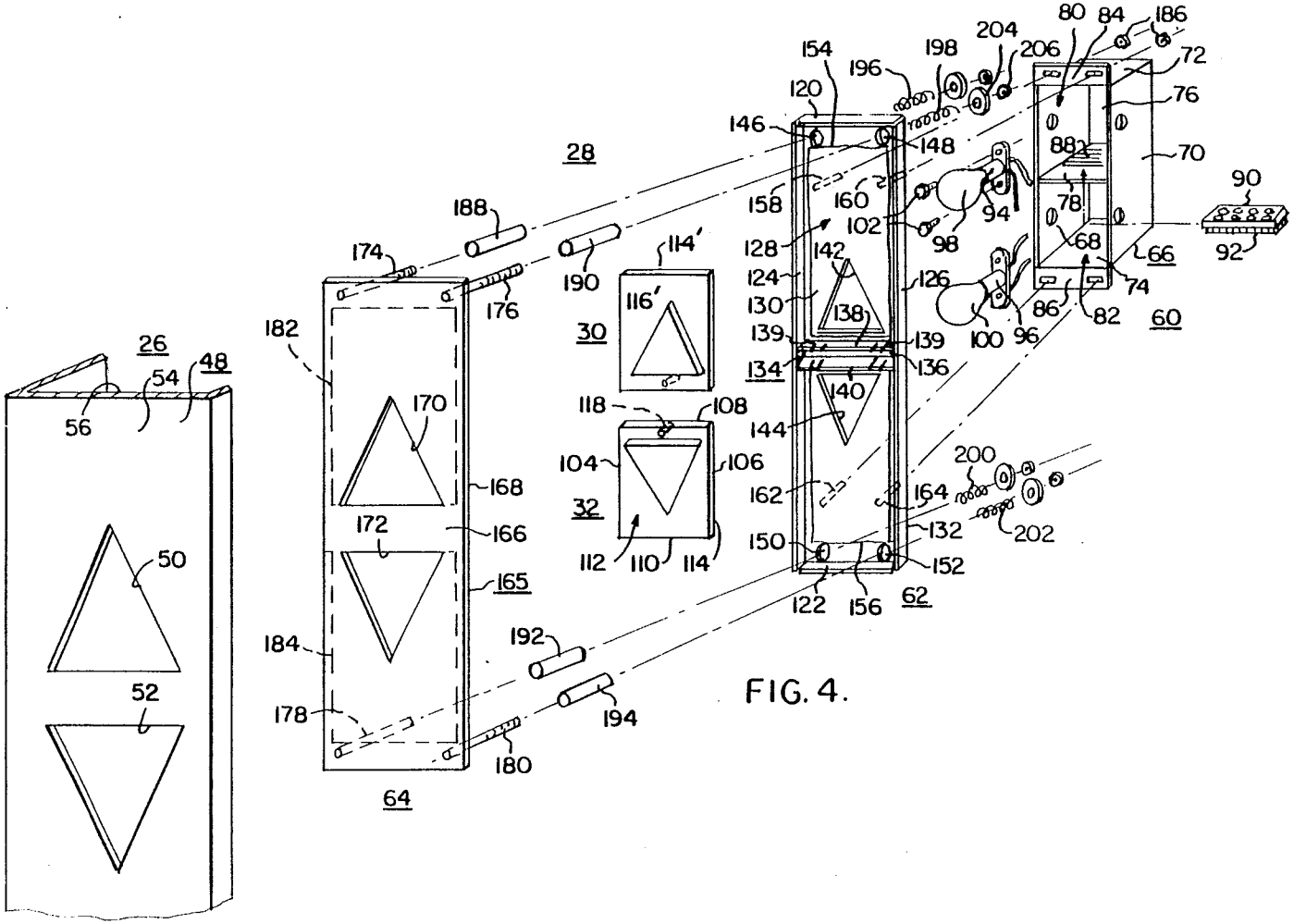
FIG. 4 is an exploded perspective view of the hall lantern assembly shown in FIG. 3.

FIG. 3 is a side elevational view of hall lantern assembly 28, partially in section, and with parts cut away, taken generally between and in the direction of arrows III—III in FIG. 1. FIG. 4 is an exploded perspective view of hall lantern assembly 28. Hall lantern assembly 28, in addition to upper and lower lenses 30 and 32 includes an electrical assembly 60, a lens guide plate 62, and means for attaching hall lantern assembly 28 to the rear surface 56 of jamb 48. If jamb 48 has a thickness dimension less than about 0.125 inch, the mounting means is preferably in the form of a back plate 64. If the thickness of jamb 48 is 0.125 inch or greater, back plate 64 may be eliminated.

More specifically, electrical assembly 60 includes an electrical junction box 66 having an open front defined by sides 68 and 70, a top 72, and a bottom 74. A rear wall 76 encloses the back of the box 66, and an intermediate horizontally oriented shelf 78 divides box 66 into upper and lower portions 80 and 82, respectively. Upper and lower mounting flanges 84 and 86, respectively, are mounted adjacent the front opening to box 66, along the front edges of the top and bottom 72 and 74, respectively. A first portion 88 of a quick release hook-like locking device (Scotchmate, Scotchlock, Velcro, etc.,) is fixed to the upper surface of shelf 78. An electrical terminal block 90, which has a second portion 92 of the hook-like locking device fixed thereto, is mounted in box 66 by pressing the first and second portions of the locking device together.

Box 66 further includes lamp sockets 94 and 96 having lamps 98 and 100 inserted therein. Lamp sockets 94 and 96 are disposed in the upper and lower enclosures 80 and 82 of box 66, and they are attached to the rear wall 76, such as by screws 102.

Lenses 30 and 32 may be of like construction, and thus only the lower lens 32 will be described. Like elements of upper lens 30 will be given the same reference numerals except with a prime mark. Lens 32 is formed of a translucent plastic or a frosted transparent plastic, and has a rectangular or square outer configuration defined by first and second sides 104 and 106, a top 108 and a bottom 110. Lens 32 has first and second ends 112 and 114, respectively, with the first end 112 including a projection 116 which has substantially the same configuration and dimensions as opening 52 in jamb 48, such as the triangle illustrated, a circle, or any other suitable configuration. The second end 114 is flat. A small hole 118 is provided in end 112, between projection 116 and the upper side 108.

The lens guide plate 62 is formed from a flat rectangular piece of sheet metal having its edges bent in a common direction to form upper and lower flanges 120 and 122, which function as lens stops, and first and second side flanges 124 and 126 which function as lens guides, all of which surround a major flat intermediate portion 128. Flat portion 128 has outer and inner surfaces 130 and 132, respectively, with "outer" referring to the surface which faces in the same direction as the outer surface 54 of jamb 48. A channel shaped member 134 having a bight 136 and spaced upper and lower leg portions 138 and 140 has its bight 136 fixed to outer surface 130 of flat portion 128 at a location intermediate the upper and lower flanges 120 and 122. The leg portions 138 and 140, which are horizontally oriented and thus parallel with the upper and lower flanges 120 and 122, also function as lens stops. At least the upper leg portion 138 has a pair of tabs 139 which may be bent upwardly as far as necessary to "fine tune" the distance the upper lens 30 drops, to make alignment of the lens and lens cutout easier.

Upper and lower openings 142 and 144 are provided in flat portion 128, above and below channel 134, with openings 142 and 144 preferably having substantially the same configuration and dimensions as openings 50 and 52, respectively, in jamb 48. Round openings 146, 148, 150 and 152 are provided in flat portion 128 adjacent to the four outer corners of the lens guide plate 62. Outer surface 130 of flat portion 128 has a low friction material disposed above and below channel 134, indicated at 154 and 156, respectively, such as tape formed of Teflon (polytetrafluoroethylene). Four threaded studs 158, 160, 162 and 164 are fixed to inner surface 132 of lens guide plate 62.

When the thickness of jamb 48 is such that it requires a back-up plate for stiffness, or when it is not desirable to spot weld studs to the inner surface 56 of jamb 48, back plate 64 is utilized. Back plate 64 is simply a flat metallic sheet 165 having a rectangular outer configuration and outer and inner surfaces 166 and 168. Upper and lower openings 170 and 172 are formed in sheet 165 which are configured and dimensioned substantially the same as openings 50 and 52, respectively, in jamb 48. Four threaded studs 174, 176, 178 and 180 are fixed to inner surface 168, adjacent the four outer corners, such as by stud welding. Similar to outer surface 130 of lens guide plate 62, the inner surface 168 of back plate 64 has a low friction material applied thereto, indicated at 182 and 184, and it may also be in the form of a tape having a low coefficient of friction.

In the event back plate 64 is not required, studs 174, 176, 178 and 180 would be fixed to inner surface 56 of jamb 48, as would be the tape 182 and 184. When back plate 64 is used, outer surface 166 of plate 165 is fixed to the inner surface 56 of jamb 48, such as with a suitable adhesive, with openings 50 and 170 in registry, and with openings 52 and 172 in registry.

Electrical assembly 60 is fixed to the inner surface 132 of lens guide plate 62, with studs 158, 160, 162 and 164 extending through openings provided in the upper and lower mounting flanges 84 and 86, and secured with nuts, such as nuts 186.

Tubular spacers 188, 190, 192 and 194 are disposed on studs 174, 176, 178 and 180, respectively, and lenses 30 and 32 are positioned with their projections 116' and 116 extending into openings 50 and 52 of jamb 48, as well as through openings 170 and 172 of back plate 64, if used. Lens guide plate 62 is mounted on the spacers via openings 146, 148, 150 and 152, which openings are sized to snugly slide on the spacers. Cylindrical compression springs 196, 198, 200 and 202 are placed over spacers 188, 190, 192 and 194, respectively, such that inner surface 132 of the lens guide plate forms one spring stop, and a washer and a nut are used to provide a remaining spring stop for each spring, such as washer 204 and nut 206 associated with spacer 190 and stud 176. Nut 206 is threadably engaged with stud 176 until washer 204 is firmly held against the outwardly extending end of spacer 190, which will compress spring 198 to hold lens guide plate 62 firmly against the flat second ends 114 and 114' of lenses 32 and 30, respectively. The flanges about lens guide plate 62 serve as vertical guides and horizontal stops for lenses 30 and 32, and they are dimensioned to be shorter than the thickness dimension of lenses 30 and 32, not including the dimension of projections 116 and 116' in the measurement. Thus, lenses 30 and 32 are held in their operative positions by lens guide plate 62, with a firm resilient bias.

Figure 8:
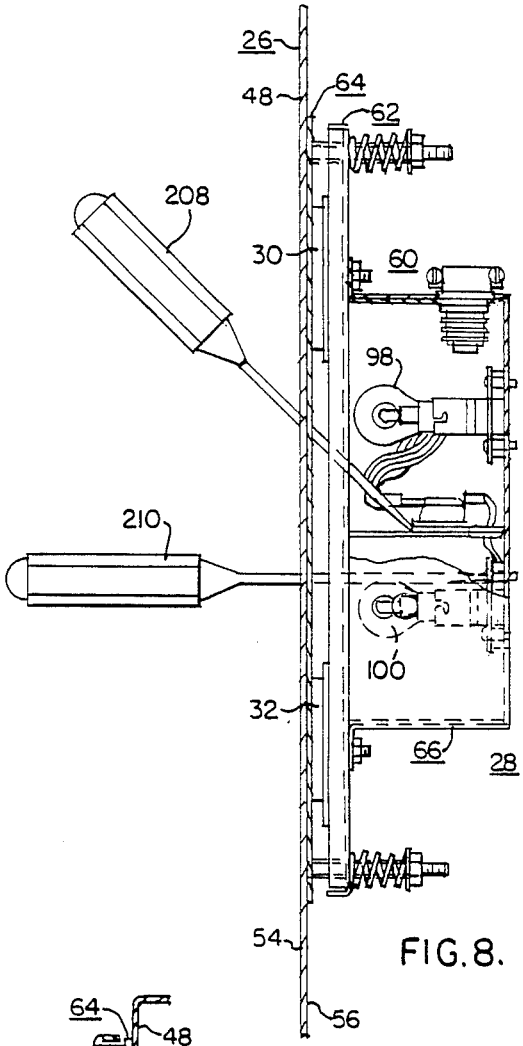
FIG. 8 is a side elevational view similar to that of FIG. 3, except with both the upper and lower lenses is service positions, and illustrating access to the hall lantern assembly with suitable tools.
Figure 7:
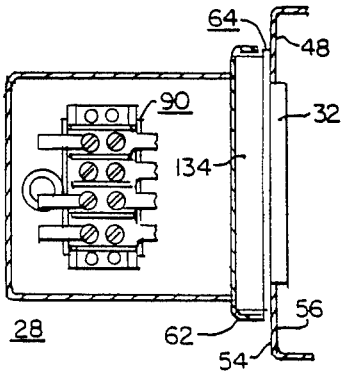
FIG. 7 is a plan view of an electrical terminal block, taken between and in the direction of arrows VII—VII in FIG. 3.
Figure 5:
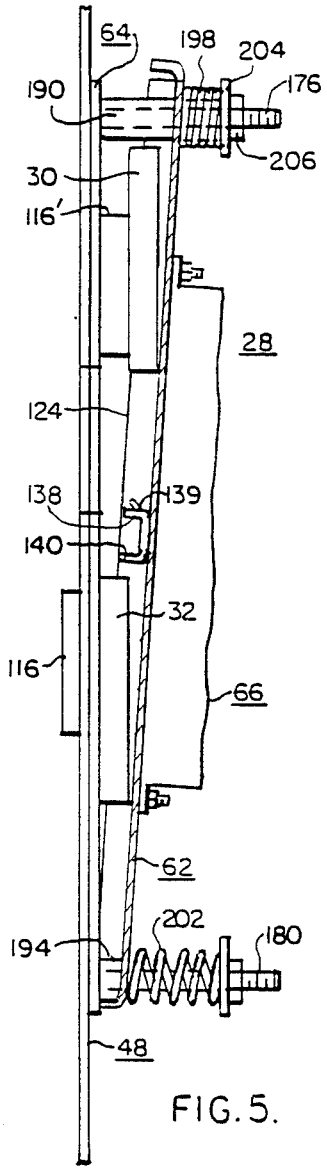
FIG. 5 is a side elevational view similar to that of FIG. 3, except illustrating the upper lens in a service position.
Figure 6:
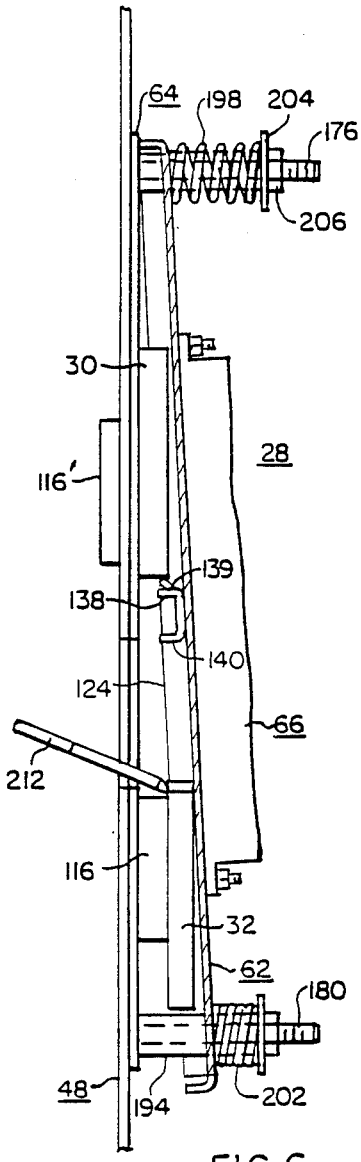
FIG. 6 is a side elevational view similar to that of FIG. 5, except illustrating the lower lens in a service position.

FIG. 5 is a side elevational view of hall lantern assembly 28 with flange 126 of lens guide plate 62 cut away, illustrating the upper lens 30 moved upwardly to a service position, and FIG. 6 is a view similar to FIG. 5, except with the lower lens 32 moved downwardly to a service position. FIG. 7 is a cross sectional view of hall lantern assembly 28, taken between and in the direction of arrows VII—VII of FIG. 3, to more clearly illustrate terminal block 90. FIG. 8 is a side elevational view similar to FIG. 5 and 6, except illustrating both the upper and lower lenses 30 and 32 moved to service positions.

To move upper lens 30 to the service position, projection 116' is pushed firmly inward until projection 116' clears opening 50, and then lens 30 is pushed upwardly, causing lens 30 to slide on low friction materials 154 and 182. The low friction materials 154 and 182, in addition to facilitating sliding movement, also function to prevent scratching the plastic lenses. Moving the upper lens 30 to its service position provides access to the upper portion 80 of electrical junction box 66, such as for replacement of bulb 98, replacement of socket 94, or access to terminal block 90. As hereinbefore described, terminal block 90 may be quickly detached via the interengaging, hook-like locking arrangement provided by locking parts 88 and 92, such as by using a screw driver 208, as shown in FIG. 8, or similar tool. To return upper lens 30 to its operative position, projection 116 of the lower lens 32 is depressed, compressing all springs, until the upper lens 30 drops by gravity to stop 138.

To move lower lens 32 to the service position, projection 116 is pushed firmly inward until projection 116 clears opening 52, and then lens 32 is pushed downwardly, causing lens 32 to slide on low friction materials 156 and 184. Moving the lower lens 32 to its service position provides access to the lower portion 82 of electrical junction box 66, such as for replacement of bulb 100, or replacement of socket 96. Screw driver 210 is shown removing or replacing socket 96. To return lower lens 32 to its operative position, the projection 116' of the upper lens 30 is depressed, compressing all springs, allowing the lower lens 32 to be lifted by inserting a tool 212 into the small opening 118, as shown in FIG. 6.

In summary, there has been shown a new and improved elevator hall lantern assembly which may be installed on any door post, a hatch door post, or either a strike post or a return post of an elevator cab having either center or side opening doors. No face plate is required, no visible fasteners are used, a swing return is not required, nor is a pop-out strike. In addition to facilitating quick service of the electrical components of the hall lantern assembly, the disclosed construction prevents damage to the lenses. For example, placing the door post on a flat surface with the lenses down during manufacture will simply depress the lenses, and not break them. In like manner, a force applied to a lens after the door post has been assembled with the cab, will simply depress the lens, and it will pop back into position without damage.

We claim:

1. In an elevator system, a door post, said post including a flat jamb having inner and outer surfaces, said flat jamb defining spaced upper and lower openings which extend between the inner and outer surfaces of the jamb, and a hall lantern assembly fixed to the inner surface of said jamb, said hall lantern assembly including a lens guide plate, spring means, lamp means, and upper and lower lenses having projecting portions which respectively extend through the upper and lower openings in the jamb, said lens guide plate including a major flat portion having inner and outer surfaces, and spaced upper and lower openings which extend between said inner and outer surfaces, said spring means resiliently biasing the outer surface of said lens guide plate towards the inner surface of said jamb, said lamp means being fixed to the inner surface of said lens guide plate, said upper and lower lenses being disposed between the outer surface of said lens guide plate and the inner surface of said jamb, with said spring means and the outer surface of said lens guide plate biasing said upper and lower lenses towards the inner surface of said jamb, said upper and lower lenses each being actuatable to a service position by pressing the projecting portion of a lens to move the lens and lens guide plate inwardly against the bias of said spring means, and then moving the lens vertically in said lens guide plate to a position which provides access to said lamp means via the openings defined by said jamb and said lens guide plate.

2. The elevator system of claim 1 wherein the hall lantern assembly further includes a back plate having inner and outer surfaces, and upper and lower openings disposed between said inner and outer surfaces, said back plate being disposed between the inner surface of the jamb and the outer surface of the lens guide plate, with the outer surface of said back plate being fixed to the inner surface of the jamb.

3. The elevator system of claim 2 including a plurality of studs fixed to the inner surface of the back plate, and a tubular spacer member disposed about each stud, and wherein the lens guide plate includes openings sized to slidably receive said tubular spacer members, and the spring means include compression springs disposed about each spacer member which bias the lens guide plate toward the back plate.

4. The elevator system of claim 2 including first and second low friction means respectively fixed to the inner and outer surfaces of the back plate and lens guide plate, which facilitate movement of the upper and lower lenses to the service positions.

5. The elevator system of claim 2 wherein the upper and lower openings defined by the jamb portion, back plate, and lens guide plate are like configured and dimensioned, and in substantial registry with one another.

6. The elevator system of claim 1 including a plurality of studs fixed to the inner surface of the jamb, and a tubular spacer member disposed about each stud, and wherein the lens guide plate includes openings sized to slidably receive said tubular spacer members, and the spring means include compression springs disposed about each spacer member which bias the lens guide plate toward the jamb.

7. The elevator system of claim 1 wherein the lamp means includes a box, an electrical terminal block, fastener means releasably fixing said terminal block to said box, lamp sockets fixed to said box and electrically connected to said terminal block, and lamps in said lamp sockets, wherein said fastener means is actuatable when at least one of the upper and lower lenses is actuated to a service position, whereby the terminal block may be quickly removed from, and reattached to, the box.

8. The elevator system of claim 1 wherein the upper and lower openings defined by the jamb and lens guide plate are like configured and dimensioned, and in substantial registry with one another.

9. The elevator system of claim 1 wherein the lens guide plate has integral vertically extending, horizontally spaced, first and second flanges which extend towards the jamb, and the first and second lenses have a width dimension selected to slidably fit the spacing between said first and second flanges.

10. The elevator system of claim 9 wherein the lens guide plate has upper, lower, and intermediate horizontally extending, vertically spaced flanges which extend towards the jamb, defining stops for the upper and lower lenses.

11. The elevator system of claim 10 wherein the intermediate flange includes bendable tabs for establishing the location of the stop.

* * * * *